US008360563B2

(12) United States Patent
Shimizu

(10) Patent No.: US 8,360,563 B2
(45) Date of Patent: Jan. 29, 2013

(54) LIQUID DROPLET JETTING APPARATUS

(75) Inventor: Yoichiro Shimizu, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 558 days.

(21) Appl. No.: 12/394,545

(22) Filed: Feb. 27, 2009

(65) Prior Publication Data

US 2009/0219320 A1 Sep. 3, 2009

(30) Foreign Application Priority Data

Feb. 29, 2008 (JP) ..... 2008-049555

(51) Int. Cl.
*B41J 2/175* (2006.01)
*B41J 2/17* (2006.01)
*B41J 2/165* (2006.01)

(52) U.S. Cl. ..... 347/85; 347/22; 347/29; 347/35; 347/94

(58) Field of Classification Search ..... 347/22, 347/29, 85

See application file for complete search history.

(56) References Cited

U.S. PATENT DOCUMENTS

| | | | | |
|---|---|---|---|---|
| 6,367,916 | B2 * | 4/2002 | Asano | 347/69 |
| 6,739,686 | B2 * | 5/2004 | Imai | 347/10 |
| 7,413,295 | B2 | 8/2008 | Takata et al. | |
| 2006/0132554 | A1 * | 6/2006 | Ota et al. | 347/85 |
| 2006/0164475 | A1 * | 7/2006 | Umeda et al. | 347/85 |

FOREIGN PATENT DOCUMENTS

| | | |
|---|---|---|
| JP | 9011459 | 1/1997 |
| JP | 2001-121713 | 5/2001 |
| JP | 2005-271546 | 10/2005 |
| JP | 2006-062330 | 3/2006 |
| JP | 2006-205415 | 8/2006 |

* cited by examiner

*Primary Examiner* — Laura Martin
*Assistant Examiner* — Jeremy Bishop
(74) *Attorney, Agent, or Firm* — Frommer Lawrence & Haug LLP

(57) ABSTRACT

A damper control section controls a piezoelectric actuator attached to a damper, in a printing mode of jetting an ink by a pressure applied by an actuator for jetting, to suppress a pressure fluctuation in an ink storage chamber, and controls the piezoelectric actuator, in a purge mode of discharging forcibly the ink in the ink-jet head as a waste liquid, to transport the ink in the ink storage chamber to the ink-jet head.

12 Claims, 11 Drawing Sheets

LIQUID DROPLET JETTING APPARATUS

CROSS REFERENCE TO RELATED APPLICATION

The present application claims priority from Japanese Patent Application No. 2008-049555, filed on Feb. 29, 2008, the disclosure of which is incorporated herein by reference in its entirety.

BACKGROUND OF THE INVENTION

1. Field of the Invention

The present invention relates to a liquid droplet jetting apparatus such as an ink-jet printer.

2. Description of the Related Art

A tube-supply-type ink jet printer in which ink supplied from a detachable ink tank via a flexible ink supply tube is temporarily stored in a sub tank on a carriage, and the ink is supplied from the sub tank to a jetting head, and printing is carried out on a recording paper by jetting the ink from nozzles of the jetting head has hitherto been known (refer to U.S. Pat. No. 7,413,295 which corresponds to Japanese Patent Application Laid-open No. 2005-271546).

In this ink-jet printer, since the ink in the ink supply tube is accelerated by an inertial force by an acceleration and a deceleration of a carriage which reciprocates, a pressure wave from the ink in the ink supply tube is propagated to the ink in the jetting head. Moreover, when the ink is jetted from the jetting head, since an inside of the sub tank is depressurized due to a decrease in an amount of ink, a refill pressure, which acts so that the sub tank is refilled with the ink from the ink tank via the ink supply tube, is generated. When the ink is jetted simultaneously from a large number of nozzles, the pressure wave propagated to the nozzles of the jetting head due to the refill pressure becomes great. Further, when the pressure wave propagated to the nozzles becomes great, there is an adverse effect on a meniscus which is formed in each of the nozzles of the jetting head, and a printing quality is deteriorated. Therefore, an ink storage chamber of the sub tank is sealed by a damper film and a pressure fluctuation on the ink is absorbed.

However, when a printing speed is increased for improving a performance of the printer, a scanning speed of the carriage increases, and an ink flow increases. Therefore, in order to absorb the pressure fluctuation of the ink sufficiently, an area of the damper film has to be increased. However, since printers in recent years tend to be made smaller, increasing the area of the damper film is not practical. To deal with this problem, a structure, in which a drive-transmission rod is connected to a central portion of a surface of the damper film and a driving force is applied to the drive-transmission rod from an actuator according to a speed change of the carriage, has been proposed (refer to Japanese Patent Application Laid-open No. 2001-121713). According to this structure, by active deformation of the damper film, it is possible to absorb more effectively the pressure fluctuation, of the ink in the ink supply tube, which is generated when the carriage reciprocates.

However, according to the structure disclosed in Japanese Patent Application Laid-open No. 2001-121713, only for suppressing the pressure fluctuation of the ink in the sub tank, an actuator etc. has to be mounted on the carriage, which becomes rather expensive from a point of cost efficiency.

SUMMARY OF THE INVENTION

An object of the present invention is to utilize more effectively a structure for absorbing a pressure fluctuation in a sub tank in a liquid droplet jetting apparatus such as an ink-jet printer.

According to a first aspect of the present invention, there is provided a liquid droplet jetting apparatus which jets liquid droplets of a liquid stored in a main tank, including: a main-tank attachment section to which the main tank is detachably attached; a sub tank having a liquid storage chamber communicating with the main tank attached to the main-tank attachment section; a liquid droplet jetting head having nozzles from which the liquid droplets are jetted, channels each of which communicates with the sub tank and guides the liquid flowed from the sub tank to the nozzles, and a pressure applying mechanism which applies, to the liquid in the channels, a pressure directed toward the nozzles to jet the liquid droplets from the nozzles; a volume changing mechanism which changes a volume of the liquid storage chamber of the sub tank; a counter-flow preventing mechanism which prevents a counter flow of the liquid toward the main tank from the liquid storage chamber of the sub tank; and a controller which controls the volume changing mechanism to change the volume of the liquid storage chamber and to suppress a pressure fluctuation in the liquid storage chamber in a liquid-droplet jetting mode of jetting the liquid droplets with the pressure applied by the pressure applying mechanism, and which controls the volume changing mechanism to change the volume of the liquid storage chamber and to transport the liquid in the liquid storage chamber to the liquid droplet jetting head in a purge mode of discharging the liquid in the liquid droplet jetting head forcibly from the nozzles.

According to the first aspect of the present invention, in the liquid-droplet jetting mode, since the controller controls the volume changing mechanism to change the volume of the liquid storage chamber of the sub tank, it is possible to suppress actively the pressure fluctuation of the liquid in the sub tank. Moreover, in the purge mode, since the controller controls the volume changing mechanism to change the volume of the liquid storage chamber of the sub tank, it is possible to prevent the blocking of the nozzles by jetting the liquid forcibly from the nozzles as a waste liquid. Consequently, it is possible to utilize effectively a structure which suppresses the pressure fluctuation in the sub tank, also for a purge operation. In other words, it is possible to utilize effectively the structure which absorbs the pressure fluctuation in the sub tank, also for the purge operation.

In the liquid droplet jetting apparatus of the present invention, the controller may have a head control section which controls the liquid droplet jetting head to jet the liquid droplets; and the controller may control, in the liquid-droplet jetting mode, the volume changing mechanism, based on a jetting amount information obtained from the head control section, to change the volume of the liquid storage chamber. In this case, it is possible to absorb a refill pressure generated when the liquid droplets are jetted from the liquid droplet jetting head by the volume changing mechanism, and moreover, it is possible to prevent a pressure wave from propagating to the nozzles of the liquid droplet jetting head. The information of jetting amount of liquid droplets means a total amount of ink that is jetted from the liquid droplet jetting head.

In the liquid droplet jetting apparatus of the present invention, the sub tank may be attached to the liquid droplet jetting head.

In the liquid droplet jetting apparatus of the present invention, the liquid droplet jetting head may jet, in the liquid-droplet jetting mode, the liquid droplets from the nozzles in a stationary state in which the liquid droplet jetting head and the sub tank are stationary. Even when the liquid droplet jetting head and the sub tank are stationary, the refill pressure is generated in the sub tank when the liquid droplets are jetted.

However, by absorbing the refill pressure by the volume changing mechanism, it is possible to prevent the pressure wave from being propagated to the nozzles of the liquid droplet jetting head.

The liquid droplet jetting apparatus of the present invention may further include a moving mechanism which reciprocates the liquid droplet jetting head together with the sub tank; and a liquid supply tube which communicates the main tank and the sub tank, and the controller may have a moving mechanism control section which controls the moving mechanism; and the controller may control, in the liquid-droplet jetting mode, the volume changing mechanism, based on a movement information of the sub tank obtained from the moving mechanism control section, to change the volume of the liquid storage chamber. When the sub tank reciprocates, the liquid in the liquid supply tube is accelerated by an inertial force, and a dynamic pressure is generated in the sub tank. Since the volume changing mechanism is capable of absorbing the dynamic pressure generated in the sub tank, it is possible to prevent the pressure wave from being propagated to the nozzles of the liquid droplet jetting head.

In the liquid droplet jetting head of the present invention, the counter-flow preventing mechanism may be a non-return valve mechanism including a valve element which is movable toward an opening position to open the channel upon receiving a flow of the liquid from the main tank directed toward the liquid storage chamber, and which is movable toward a closing position to close the channel upon receiving a counter flow of the liquid from the liquid storage chamber toward the main tank; and the valve element may not be moved toward the closing position by the counter flow due to the pressure fluctuation inside the liquid storage chamber in the liquid jetting mode, and may be moved toward the closing position by the counter flow due to a pressure fluctuation in the liquid storage chamber in the purge mode. Moreover, the valve element may be arranged at an inflow port of the liquid formed in a sub tank, the valve element may include a shaft which has one end inserted in the inflow port with a clearance space with respect to the inflow port, and an umbrella portion which is elastic and is projected in an umbrella shape folding back from the other end of the shaft; and a projection extending in a radial direction of the umbrella portion may be formed on a surface of the umbrella portion, and the surface may face the shaft. Since the valve element does not close the channel in the liquid-droplet jetting mode, it is possible to prevent the liquid flowed into the sub tank from the liquid supply tube by the inertial force due to the reciprocating movement of the sub tank from being accumulated in the sub tank, and remaining under a high pressure. Moreover, when a substantial pressure is applied to inside of the sub tank by the volume changing mechanism for the purge, since the valve element closes the channel, it is possible to prevent the counter flow appropriately.

The liquid droplet jetting apparatus of the present invention may further include a tray which receives the liquid discharged forcibly from the nozzles, in the purge mode, and the counter-flow preventing mechanism may be a pinching mechanism which pinches an outer portion of the liquid supply tube and blocks an internal channel of the tube when the liquid droplet jetting head is moved by the scanning mechanism to a position above the tray. Moreover, the liquid droplet jetting apparatus may further include a maintenance area to which the liquid droplet jetting head is moved in the purge mode, and the pinching mechanism may be arranged at the maintenance area together with the tray, and may have an oscillator which is arranged below a moving path of the liquid droplet jetting head and a receiver which is fixed to a portion above the moving path of the liquid droplet jetting head to face the oscillator, and the liquid supply tube may be pinched with the oscillator and the receiver. When the liquid droplet jetting head and the sub tank move to the position above the tray, since the internal channel of the liquid supply tube is blocked, it is possible to prevent easily the counter flow at the time of purge.

In the liquid droplet jetting apparatus of the present invention, the sub tank may have a damper film which forms at least a part of a wall which defines the liquid storage chamber, and the volume changing mechanism may include a piezoelectric actuator which deforms the damper film and a voltage applying mechanism which applies a voltage to the piezoelectric actuator. By deforming the damper film by the piezoelectric actuator, it is possible to change easily the volume of the liquid storage chamber of the sub tank.

In the liquid droplet jetting apparatus of the present invention, the piezoelectric actuator may be attached directly on a surface, of the damper film, not facing the liquid storage chamber. Since the piezoelectric actuator is attached directly on the damper film, it is possible to make the structure compact.

In the liquid droplet jetting apparatus of the present invention, in the purge mode, the controller may control the voltage applying mechanism to apply to the piezoelectric actuator a voltage higher than a voltage in the liquid-droplet jetting mode, and may cause the piezoelectric actuator to be deformed to a greater extent than in the liquid-droplet jetting mode to change the volume of the liquid storage chamber to a greater extent than in the liquid-droplet jetting mode. In this case, only by changing a voltage value, it is possible to use properly the pressure-fluctuation absorption and the purge.

In the liquid droplet jetting apparatus of the present invention, the piezoelectric actuator may have two piezoelectric sheets; in the liquid-droplet jetting mode, the controller may control the voltage applying mechanism to apply a voltage to only one of the piezoelectric sheets so that the one of the piezoelectric sheets is deformed in a unimorph mode; and in the purge mode, the controller may control the voltage applying mechanism to apply a voltage to both of the two piezoelectric sheets so that the two piezoelectric sheets are deformed in a bimorph mode. In this case, only by changing the sheet, out of the two sheets, to which the voltage is applied, it is possible to use properly the pressure-fluctuation absorption and the purge.

According to a second aspect of the present invention, there is provided a liquid droplet jetting apparatus which jets liquid droplets of a liquid, including: a main tank which stores the liquid; a sub tank having a liquid storage chamber communicating with the main tank via a tube which is connected to the main tank; a liquid droplet jetting head having nozzles from which the liquid droplets are jetted, channels each of which communicates with the sub tank and guides the liquid flowed from the sub tank to one of the nozzles, and a pressure applying mechanism which applies, to the liquid in the channels, a pressure directed toward the nozzles to jet the liquid droplets from the nozzles; a volume changing mechanism which changes a volume of the liquid storage chamber of the sub tank; a counter-flow preventing mechanism which prevents a counter flow of the liquid toward the main tank from the liquid storage chamber of the sub tank; and a controller which controls the volume changing mechanism to change the volume of the liquid storage chamber and to suppress a pressure fluctuation in the liquid storage chamber in a liquid-droplet jetting mode of jetting the liquid droplets with the pressure applied by the pressure applying mechanism, and which controls the volume changing mechanism to change the volume of the liquid storage chamber and to transport the liquid in the liquid storage chamber to the liquid droplet jetting head in a purge mode of discharging the liquid in the liquid droplet jetting head forcibly from the nozzles.

According to the second aspect of the present invention, in the liquid-droplet jetting mode, since the controller controls the volume changing mechanism to change the volume of the liquid storage chamber of the sub tank, it is possible to suppress actively the pressure fluctuation of the liquid in the sub tank. Moreover, in the purge mode, the controller controls the volume changing mechanism to change the volume of the liquid storage chamber of the sub tank, it is possible to prevent the blocking of the nozzles by jetting the liquid forcibly from the nozzles as a waste liquid. Consequently, it is possible to utilize effectively a structure which suppresses the pressure fluctuation in the sub tank, also for a purge operation. In other words, it is possible to utilize effectively the structure which absorbs the pressure fluctuation in the sub tank, also for the purge operation.

DETAILED DESCRIPTION OF THE PREFERRED EMBODIMENTS

Exemplary embodiments according to the present invention will be described below by referring to the accompanying diagrams. In the following description, a direction of jetting the ink from an ink-jet head is defined as a downward direction and a direction opposite to the downward direction is defined as an upward direction.

Figure 1:
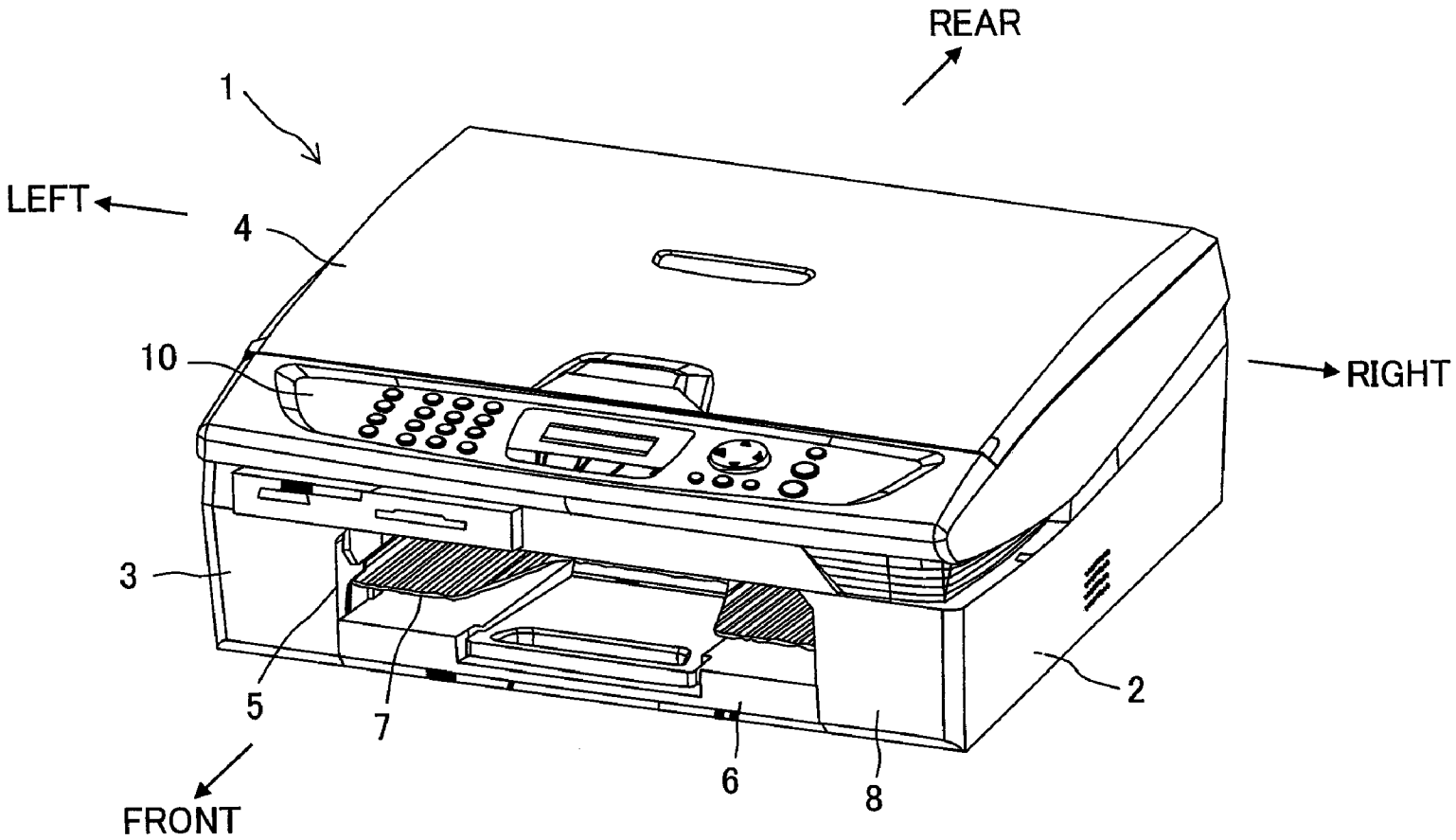
FIG. 1 is a perspective view showing a multifunction device having an ink-jet printer which is a liquid droplet jetting apparatus according to a first embodiment of the present invention.

FIG. 1 is a perspective view showing a multifunction device (MFD) 1 having an ink-jet printer 3 which is a liquid droplet jetting apparatus according to a first embodiment of the present invention. As shown in FIG. 1, the multifunction device 1 is a device having a printer function, a scanner function, a copy function, and a facsimile function, and has the ink-jet printer 3 at a lower portion of a casing 2 thereof, and has a scanner 4 at an upper portion of the casing 2. An opening 5 is formed on a front surface of the casing 2. A paper feeding tray 6 of the ink-jet printer 3 is provided at a lower stage of the opening 5, and a paper discharge tray 7 of the ink-jet printer 3 is provided at an upper stage thereof. A main tank mounting portion 26 (refer to FIG. 2) is provided at an inner side of an openable lid 8. An operation panel 10 for operating the ink-jet printer 3 and the scanner 4 is provided at an upper-portion front-surface side of the multifunction device 1. The multifunction device 1 can be operated based on instructions from the operation panel 10 or instructions transmitted from an external personal computer 11 via a driver 12 (see FIG. 3).

Figure 2:
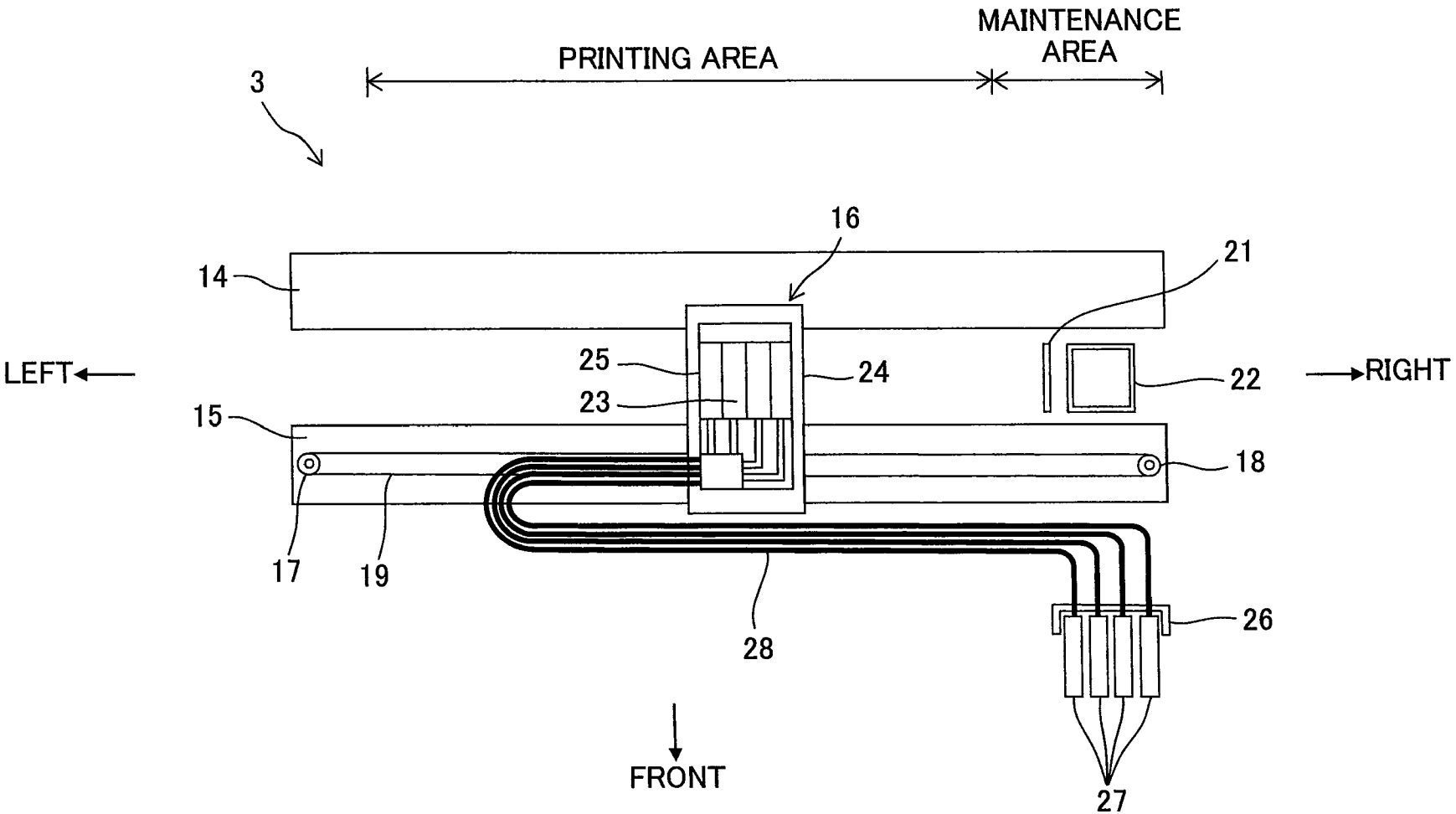
FIG. 2 is a plan view explaining an outline of the ink-jet printer shown in FIG. 1.

FIG. 2 is a plan view explaining an outline of the ink-jet printer 3 shown in FIG. 1. As shown in FIG. 2, the ink-jet printer 3 is a serial ink-jet printer, and has a pair of guide rails 14 and 15 arranged substantially parallel. An image recording unit 16 is slidably supported in a left-right direction (scanning direction) on the guide rails 14 and 15. The image recording unit 16 has a carriage 24 which is a casing, and a sub tank 25 having four ink storage chambers 23 which temporarily store the ink, is provided to the carriage 24. Moreover, a main tank mounting portion 26 is provided at a right frontward side of the guide rail 15. Four main tanks 27 in the form of cartridges (for inks of black, cyan, magenta, and yellow colors) are detachably mounted on the main tank mounting portion 26. Each main tank 27 mounted on the main tank mounting portion 26 is connected to the sub tank 25 via an ink supply tube 28. The ink supply tube 28 is guided in a scanning direction from the sub tank 25.

The image recording unit 16 is joined to a timing belt 19 put around a pair of pulleys 17 and 18, and the timing belt 19 is arranged to be substantially parallel to a direction in which the guide rail 15 is extended. A carriage motor 49 (refer to FIG. 3) which drives in a normal and a reverse direction is provided as a moving mechanism to the pulley 18. The timing belt 19 reciprocates by the pulley 18 being driven in the normal and the reverse direction, and the image recording unit 16 reciprocates along the guide rails 14 and 15.

An area in which the image recording unit 16 reciprocates includes a printing area in which an image recording on a recording papers 30 which is a recording medium (refer to FIG. 3) is carried out, and a maintenance area in which the image recording is not carried out. In the maintenance area, a wiper plate 21 and a waste-liquid tray 22 are arranged at a lower side between the pair of guide rails 14 and 15. In the maintenance area, a wiping operation of wiping by the wiper plate 21 a nozzle surface which is a lower surface of the image recording unit 16, and a purge operation of jetting forcibly the ink as a waste liquid for removing dry ink and impurities from the nozzles of the image recording unit 16 are carried out.

Figure 3:
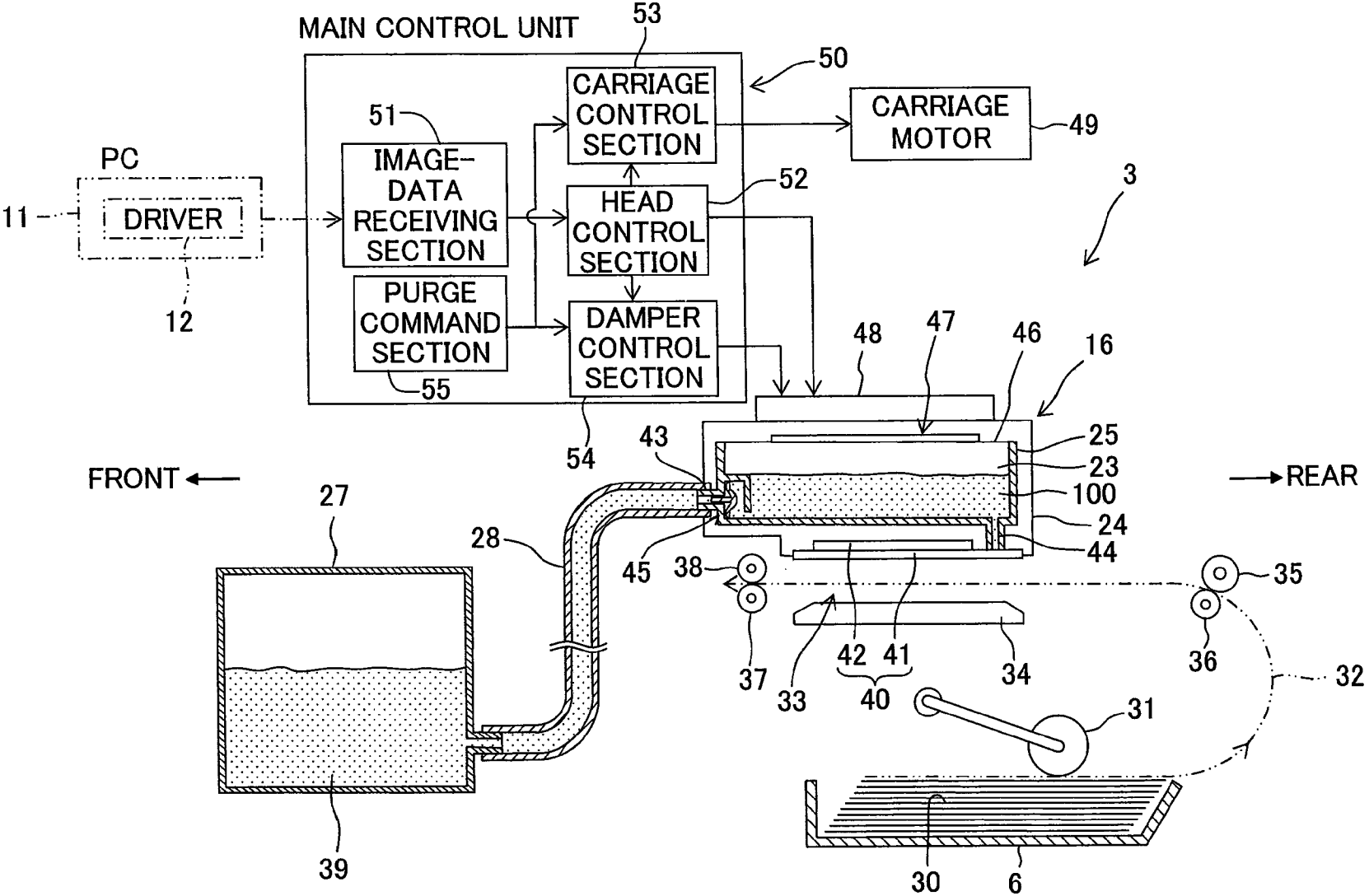
FIG. 3 is a partial cross-sectional view explaining schematically the ink-jet printer shown in FIG. 1.

FIG. 3 is a partial cross-sectional view explaining schematically the ink-jet printer shown in FIG. 1. As shown in FIG. 3, the paper feeding tray 6 is arranged at a bottom side of the ink-jet printer 3. A paper feeding drive roller 31 which supplies a recording paper on the top of the recording papers 30 stacked in the paper feeding tray 6 is provided at an upper side of the paper feeding tray 6. A transporting path 32 takes a U-turn toward a front-surface side after being directed upward from a rear side of the paper feeding tray 6, and leads to the paper discharge tray 7 (refer to FIG. 1) upon passing a printing area 33.

A platen 34 is arranged at a lower side of the image recording unit 16. A transporting roller 35 and a pinching roller 36 which pinch and transport the recording paper 30 passing through the transporting path 32 on to the platen 34 are provided at an upstream side of the image recording unit 16. A paper discharge roller 37 and a pinching roller 38 which pinch and transport the recording paper 30 subjected to printing toward the paper discharge tray 7 (refer to FIG. 1) are provided at a downstream side of the image recording unit 16.

The image recording unit 16 has (includes) the sub tank 25 for buffer, an ink-jet head 40 (liquid droplet jetting head) which jets an ink 100 which has flowed in from the sub tank 25 toward the platen 34 from a plurality of nozzles, and a driving circuit board 48 (a voltage applying mechanism) which is connected to the ink-jet head 40 via a flexible wire material 85 (refer to FIG. 4), and which controls the driving of the ink-jet head 40. The ink-jet head 40 includes a channel unit 41 having a plurality of channels which guides the ink 100 flowed in from the sub tank 25 up to the plurality of nozzles 74 (refer to FIG. 4), and an actuator 42 for jetting (hereinafter, "jetting actuator 42") (pressure applying mechanism) of a piezoelectric type which selectively applies a jetting pressure to the ink inside the channel in the channel unit 41 to direct the ink to the nozzles. An ink storage chamber 23 of the main tank 27 communicates with the ink storage chamber 23 of the sub tank 25 via the ink supply tube 28.

The sub tank 25 has an inflow port 43 through which the ink flows from the ink supply tube 28, and an outflow port 44 through which, the ink flows out toward the ink-jet head 40. A non-return valve mechanism 45, which will be described later, is provided at the inflow port 43 as a counter-flow preventing mechanism which is capable of preventing a counter flow of ink from the ink storage chamber 23 of the sub tank 25 to the main tank 27.

An opening of upper surface of the ink storage chamber 23 of the sub tank 25 is sealed by a damper film 46 which is a flexible resin film. A piezoelectric actuator 47 for damper (hereinafter, "damper piezoelectric actuator 47") in the form of a film is stuck directly on an upper surface of the damper film 46. In other words, by the damper piezoelectric actuator 47 being driven by the voltage applied from the driving circuit board 48, the damper film 46 is deformed, and it is possible to change a volume of the ink storage chamber 23. Namely, the driving circuit board 48 and the damper piezoelectric actuator 47 function as a volume changing mechanism for changing the volume of the ink storage chamber 23.

The ink-jet printer 3 includes a main control unit 50 which transmits a control signal to the driving circuit board 48. In other words, a controller includes the driving circuit board 48 and the main control unit 50. The main control unit 50 includes a central processing unit (CPU), a read only memory (ROM) in which computer programs to be executed by the CPU and data to be used in the computer program are stored, a random access memory (RAM) which temporarily stores data at the time of executing the computer program, a rewritable memory such as an electrically erasable and programmable read only memory (EEPROM), input/output interfaces, and the like. Functionally, the main control unit 50 includes an image-data receiving section 51, a head control section 52, a carriage control section 53 (moving mechanism control section), a damper control section 54, and a purge command section 55. The image-data receiving section 51 has a function of receiving image data from the scanner 4, or from the personal computer 11 via the driver 12, and includes a data buffer which temporarily stores the image data.

The head control section 52 transmits an ink jetting command corresponding to image data stored in a data buffer section to the driving circuit board 48, and transmits a scanning command of the carriage 24 corresponding to the image data to the carriage control section 53, and also transmits a pressure-fluctuation absorbing command corresponding to the image data to the damper control section 54. The carriage control section 53 controls driving of the carriage motor 49 for scanning the carriage 24. The damper control section 54 controls an operation of the damper piezoelectric actuator 47. The purge command section 55, according to a command by an operation carried out by a user, transmits to the damper control section 54, a purge signal for jetting forcibly the ink as a waste liquid from the nozzle of the image recording unit 16, and transmits to the carriage control section 53, a signal for moving the carriage 24 to the maintenance area.

Figure 4:
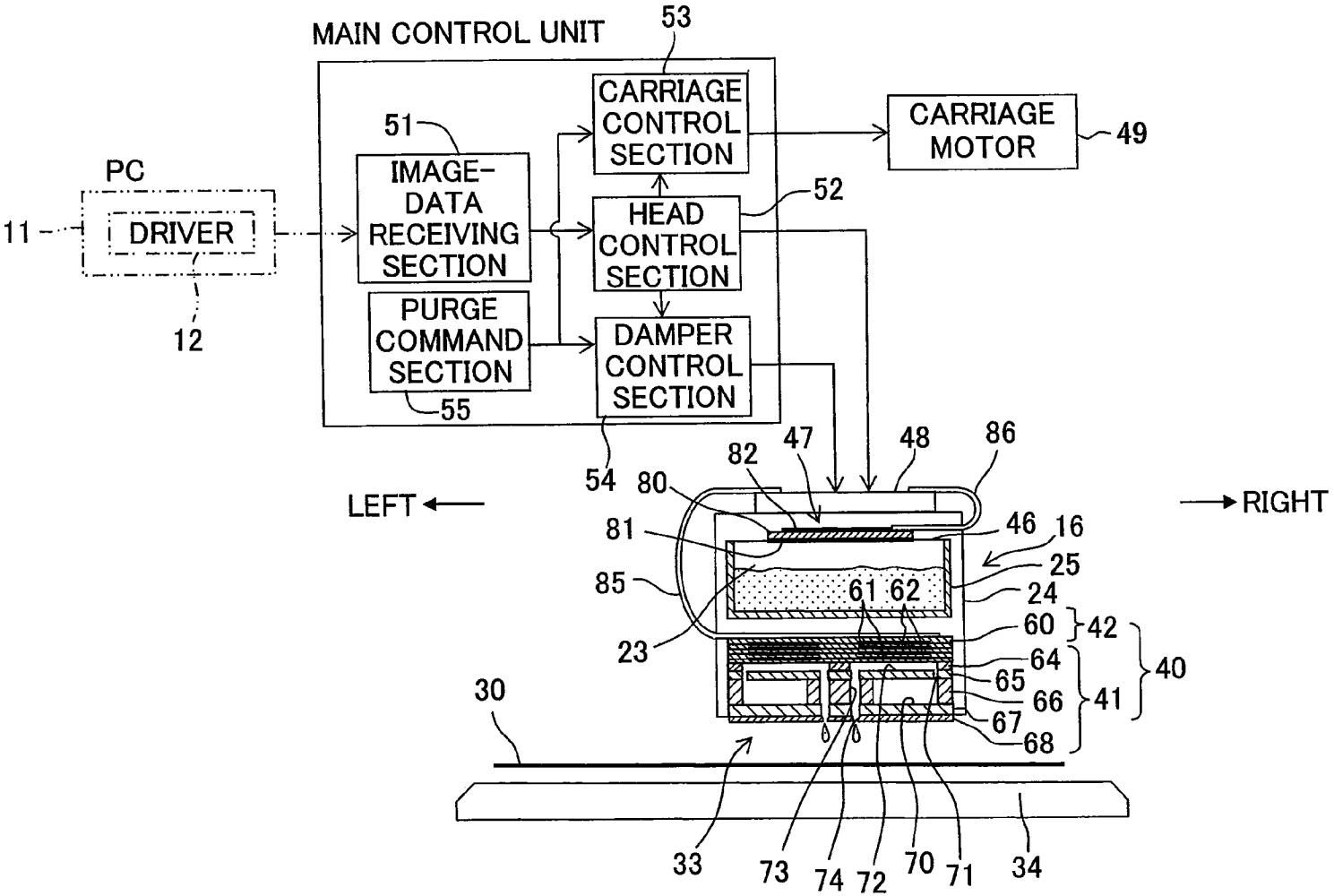
FIG. 4 is a partial cross-sectional view in which key components of the ink-jet printer shown in FIG. 1 are enlarged.

FIG. 4 is a partial cross-sectional view in which, key components of the ink-jet printer 3 shown in FIG. I are enlarged. As shown in FIG. 4, in the ink-jet head 40, the channel unit 41 and the jetting actuator 42 are stacked and adhered as described above, and the jetting actuator 42 is connected to the driving circuit board 48 via the flexible wire material 85. The channel unit 41 has a plurality of plates 64 to 68 having an opening which forms an ink channel at an interior, which is stacked and adhered. A plurality of nozzles 74 opening downward are arranged in a row in the lowermost plate 68. A plurality of pressure chambers 72 are formed in the uppermost plate 64, and are arranged in a row corresponding to the plurality of nozzles 74. An inflow channel 73 which communicates with the nozzle 74 is provided at one end portion of a longitudinal direction (left-right scanning direction in the diagram) of the pressure chamber 72, and a diaphragm channel 71 which communicates with a common liquid chamber 70 is provided at the other end portion of the pressure chamber 72. The common liquid chamber 70 is arranged to be extended in a direction of row orthogonal to the scanning direction to overlap continuously with the plurality of pressure chambers 72 in a plan view. Ink from the sub tank 25 (refer to FIG. 3) is supplied to the common liquid chamber 70 through an ink supply port (not shown in the diagram) which opens on the upper surface of the channel unit 41.

The jetting actuator 42 has a plurality of piezoelectric bodies 60 in the form of a sheet made of a material such as lead zirconium titanate (PZT) stacked, and is arranged to cover the pressure chamber 72. On an upper surface of even numbered piezoelectric bodies 60 counted from below, an individual electrode 61 is provided corresponding to each pressure chamber 72. On an upper surface of odd number piezoelectric bodies 60 counted from below, a common electrode 62 which is formed continuously corresponding to the plurality of pressure chambers 72 is provided. In other words, the individual electrode 61 and the common electrode 62 are arranged face-to-face, sandwiching the piezoelectric bodies 60 of one layer excluding the lowermost layer and the uppermost layer piezoelectric bodies. Moreover, by applying a voltage between the individual electrode 61 and the common electrode 62 of the jetting actuator 42 from the driving circuit board 48 via the flexible wiring member 85, a desired location of the piezoelectric body 60 is deformed in a direction of stacking, and a volume of a desired pressure chamber 72 is changed so that the ink is jetted from the nozzle 74.

Moreover, the damper piezoelectric actuator 47 includes a piezoelectric sheet 80, a lower electrode 81 which is formed on a lower surface of the piezoelectric sheet 80, and an upper electrode 82 which is formed on an upper surface of the piezoelectric sheet 80. The piezoelectric sheet 80 is a piezoelectric element in the form of a thin film which is transparent and flexible, and is a ferroelectric high-molecular film obtained by carrying out processes such as a stretching treatment and a polarization treatment on a compound such as polyvinylidene fluoride. The lower electrode 81 and the upper electrode 82 are transparent electrodes on which a material such as ITO (indium tin oxide) is coated as a film by a method such as vapor deposition and sputtering. The lower electrode 81 and the upper electrode 82 are connected to the driving circuit board 48 via the flexible wire material 85. When a voltage is applied between the lower electrode 81 and the upper electrode 82, the piezoelectric sheet 80 is deformed, and the damper film 46 is deformed. Accordingly, a volume of the ink storage chamber 23 is changed. Higher a value of voltage applied between the lower electrode 81 and the upper electrode 82, more substantial is a change in the volume of the ink storage chamber 23 by the damper piezoelectric actuator 47.

The main control unit 50, in a printing mode (liquid-droplet jetting mode) in which the ink is jetted by a pressure applied by the jetting actuator 42, controls the damper piezoelectric actuator 47 to suppress a pressure fluctuation in the ink storage chamber 23 of the sub tank 25. Moreover, the main control unit 50, in a purge mode in which the ink inside the ink-jet head 40 is discharged forcibly as a waste liquid, controls the damper piezoelectric actuator 47 to transport the ink in the ink storage chamber 23 of the sub tank 25 to the ink-jet head 40.

Figure 5A:
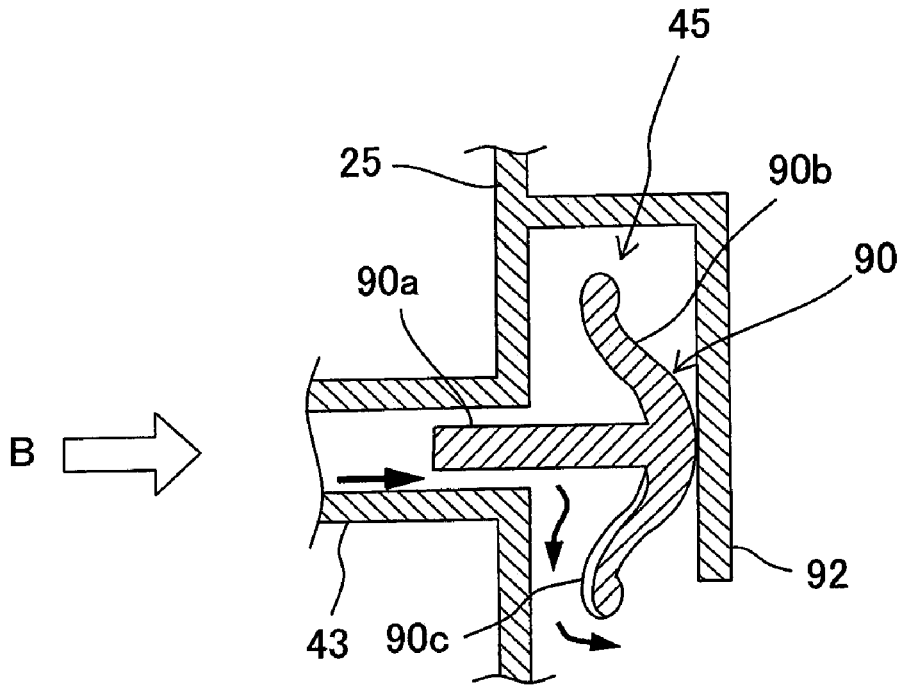
FIG. 5A is a cross-sectional view of a non-return valve mechanism at an opening position.
Figure 5B:
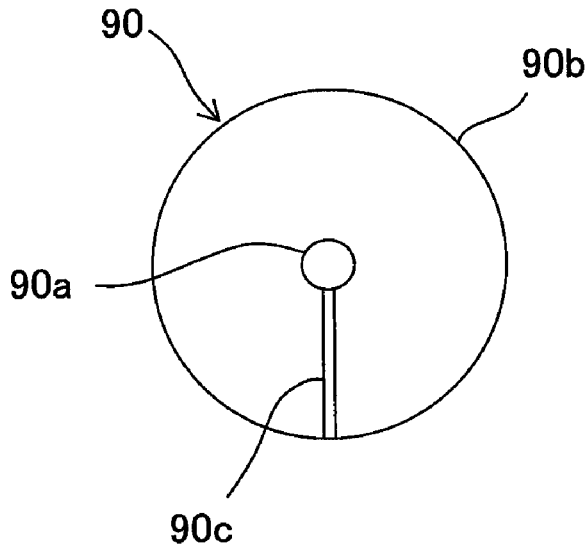
FIG. 5B is a plan view when the non-return valve mechanism is seen from a direction B in FIG. 5A.

FIG. 5A is a cross-sectional view of the non-return valve mechanism 45, and FIG. 5B is a plan view when the non-return valve mechanism 45 is seen from a direction B in FIG. 5A. As shown in FIG. 5A and FIG. 5B, the non-return valve mechanism 45 includes a valve element 90 near the inflow port 43 of the sub tank 25. The valve element 90 includes a shaft 90*a* having one end inserted into the inflow port 43 in the form of a pipe with a clearance space with respect to the inflow port 43, and an umbrella portion 90*b* which is elastic and is projected in an umbrella shape folding back from the other end, of the shaft 90*a*, at a side of the ink storage chamber 23. A projection 90*c* extending in a radial direction is formed on a surface, of the umbrella portion 90*b*, facing the shaft 90*a*. The projection 90*c* is formed of a material such as rubber or silicon. Moreover, a stopper 92 for holding the valve element 90 at an opening position such that the shaft 90*a* of the valve element 90 does not come off and fall apart from the inflow port 43 in the form of a pipe is protruded from a wall surface of the sub tank 25. Accordingly, as the ink flows from the main tank 27 to the sub tank 25, the valve element 90 moves toward an opening position which opens the channel of the inflow port 43.

Figure 6A:
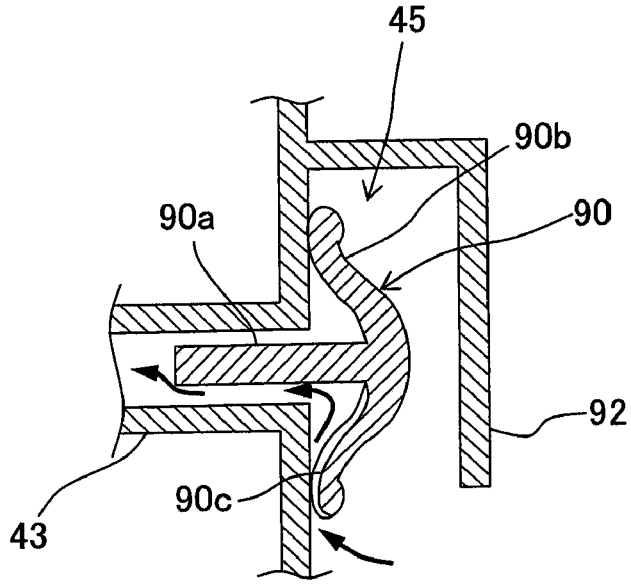
FIG. 6A is a cross-sectional view of the non-return valve mechanism at a half-closing position.
Figure 6B:
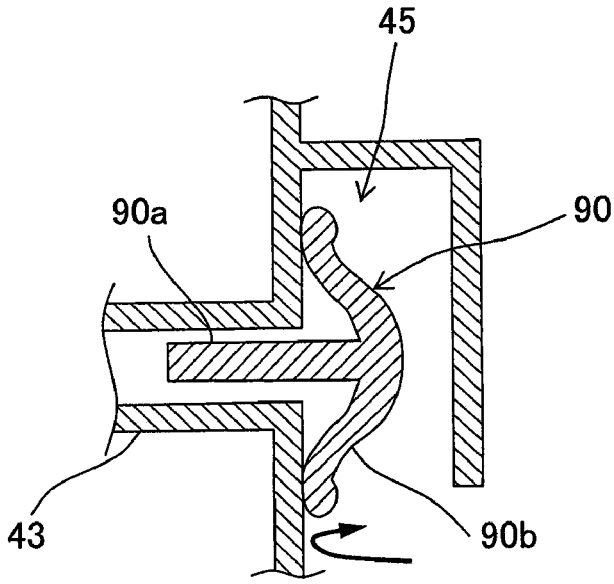
FIG. 6B is a cross-sectional view of the non-return valve mechanism at a closing position.

FIG. 6A is a cross-sectional view of the non-return valve mechanism 45 at a half-closing position, and FIG. 6B is a cross-sectional view of the non-return valve mechanism at a closing position. As shown in FIG. 6A, when the ink-jet printer 3 is in the printing mode, even when a counter-flow pressure is applied to the valve element 90, the counter-flow pressure being small, the channel of the inflow port 43 does not close completely. In other words, even when the valve element 90 makes a contact with a wall surface of the ink storage chamber 23 near the inflow port 43, there is a slight gap between the umbrella portion 90*b* and the wall surface, near the projection 90*c*. Accordingly, the ink which has flowed to the ink storage chamber 23 from the ink supply tube 28 by an inertial force due to the reciprocating movement of the sub tank 25 is prevented from being stored in the ink storage chamber 23 causing a high pressure.

As shown in FIG. 6B, when the ink-jet printer 3 is in the purge mode, a substantial pressure in a counter-flow direction being applied to the valve element 90, the projection 90*c* and the umbrella portion 90*b* of the valve element 90 are deformed elastically, and the gap near the projection 90*c* is closed. In other words, the valve element 90 is deformed to be moved at a closed position at which the channel of the inflow port 43 is completely closed. Accordingly, the counter flow is prevented in the purge mode which will be described later.

Figure 7:
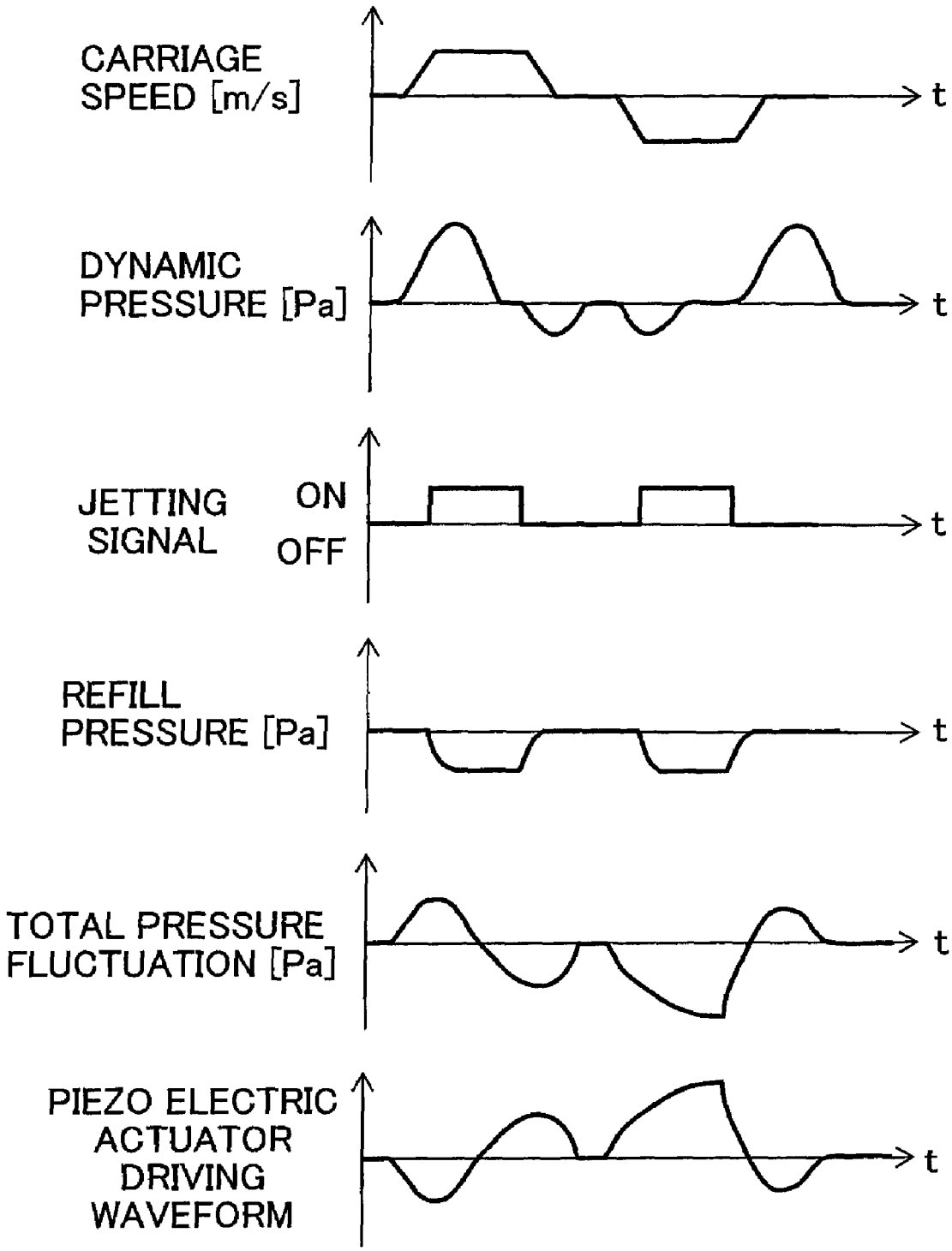
FIG. 7 is a timing chart of various operations of the ink-jet printer shown in FIG. 1.

Next, an operation in the printing mode of the ink-jet printer 3 will be described below while referring to diagrams such as FIG. 4 and FIG. 7. FIG. 7 is a timing chart of various operations of the ink-jet printer 3 shown in FIG. 1. As shown in FIG. 4, in the printing mode, when the image-data receiving section 51 receives image data, the head control section 52 transmits to the carriage control section 53 a scanning command of the carriage 24 corresponding to the image data, and also transmits to the driving circuit board 48 an ink jetting command corresponding to the image data. Accordingly, the ink is jetted toward the recording paper 30 from the ink jet head 40 while the carriage 24 reciprocates.

At this time, as shown in FIG. 7, since a speed of the carriage 24 changes while accelerating and deceleration (with acceleration and deceleration), there is a transfer of ink between the ink supply tube 28 and the sub tank 25 due to the inertial force, and a dynamic pressure is generated in the ink storage chamber 23 of the sub tank 25. Moreover, as the ink is jetted from the ink-jet head 40 according to a jetting signal, the ink inside the sub tank 25 decreases and the ink storage chamber 23 is depressurized. Accordingly, a refill pressure for replenishing the ink in the sub tank 25 from the ink supply tube 28 is generated.

As it has been described above, in the printing mode, a total pressure fluctuation in which the dynamic pressure and the refill pressure are superimposed (refer to FIG. 7) is generated in the ink in the ink storage chamber 23 of the sub tank 25. Accordingly, the damper control section 54 controls the damper piezoelectric actuator 47 to drive so that the total pressure fluctuation in FIG. 7 is canceled. Concretely, the damper control section 54 calculates the dynamic pressure based on an information about movement such as a position, a speed, and an acceleration of the carriage 24 which is obtained from an linear encoder (not shown in the diagram) of the carriage motor 49 via the carriage control section 53 (in other words, the information of movement of the sub tank 25) (the dynamic pressure may be calculated by taking into account not only the information about movement but also an environmental temperature). Also, the damper control section 54 calculates the refill pressure by obtaining information about a jetting amount which is an amount of total ink jetted from the nozzles of the ink-jet head 40 via the head control section 52. For instance, a relationship between the jetting amount and the refill pressure may be stored in advance as a table in the main control unit 50, and the refill pressure may be read out from the table based on the information of jetting amount. Or, a formula for calculating the refill pressure from the information of jetting amount may be stored in the main control unit 50, and the refill pressure may be calculated based on the information of the jetting amount. Further, the damper control section 54 controls the damper piezoelectric actuator 47 to drive so that the sum of the dynamic pressure and the refill pressure is canceled. Accordingly, a pressure wave due to the dynamic pressure and the refill pressure is prevented from being propagated to the nozzles of the ink-jet head 40.

Next, an operation in the purge mode of the ink-jet printer 3 will be described below while referring to diagrams such as FIG. 2 and FIG. 4. As a purge signal is generated by the purge command section 55, the mode is switched from the printing mode to the purge mode. In the purge mode, firstly, the carriage control section 53 moves the carriage 24 such that the ink-jet head 40 is positioned right above the waste-liquid tray 22. Further, the damper control section 54 which has received the purge signal drives the damper piezoelectric actuator 47. At this time, a value of the voltage applied to the damper piezoelectric actuator 47 is higher than a value of the voltage applied in the printing mode. Accordingly, a pressure fluctuation higher than the dynamic pressure described above is generated in the ink storage chamber 23 of the sub tank 25. In the purge mode, the jetting actuator 42 is not driven.

At a timing at which, a negative pressure is generated in the ink storage chamber 23 due to the pressure fluctuation by the damper piezoelectric actuator 47, the valve element 90 of the non-return valve mechanism 45 moves to the opening position (refer to FIG. 5A), and the ink flows into the ink storage chamber 23 of the sub tank 25 from the main tank 27 and the ink supply tube 28. On the other hand, at a time at which, a positive pressure is generated in the ink storage chamber 23 due to the pressure fluctuation by the damper piezoelectric actuator 47, the valve element 90 of the non-return valve mechanism 45 moves to the closed position (refer to FIG. 6B), and the ink in the ink storage chamber 23 is sent forcibly toward the ink-jet head 40. Accordingly, the ink is jetted forcibly as a waste liquid from all the nozzles of the ink-jet head 40, toward the waste-liquid tray 22. In other words, the damper piezoelectric actuator 47 serves as a positive-pressure pump.

According to the structure described above, in the printing mode, by changing a volume of the ink storage chamber 23 of the sub tank 25 by the damper piezoelectric actuator 47, it is possible to suppress actively the pressure fluctuation in the ink inside the sub tank 25. Moreover, in the purge mode, by changing the volume of the ink storage chamber 23 of the sub tank by the damper piezoelectric actuator 47, it is possible to prevent the blocking of the nozzles by jetting forcibly the ink from the ink-jet head 40 as a waste liquid. Consequently, it is possible to use effectively for the purge operation the structure which suppresses the pressure fluctuation in the sub tank 25.

Figure 8:
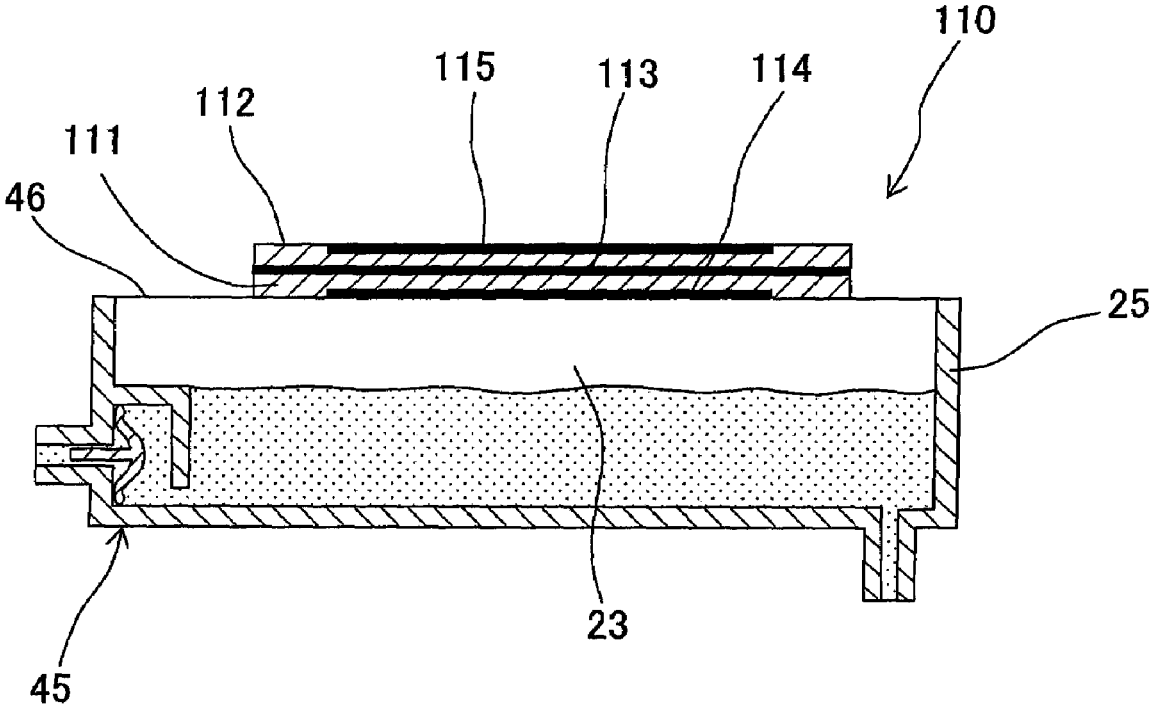
FIG. 8 is a cross-sectional view of key components explaining a piezoelectric actuator included in an ink-jet printer of a second embodiment of the present invention.

FIG. 8 is a cross-sectional view of key components explaining a piezoelectric actuator 110 for damper (hereinafter, "damper piezoelectric actuator 110") of an ink-jet printer of a second embodiment. As shown in FIG. 8, the damper piezoelectric actuator 110 has two layers of piezoelectric sheets 111 and 112, an intermediate electrode 113 which is formed between the piezoelectric sheet 111 and the piezoelectric sheet 112, and is kept at a ground electric potential, a lower electrode 114 which is formed on an upper surface of the piezoelectric sheet 111, and an upper electrode 115 which is formed on an upper surface of the piezoelectric sheet 112.

In the printing mode, a voltage is not applied to the upper electrode 115, but is applied only to the lower electrode 114, and the lower layer piezoelectric sheet 111 is made to undergo unimorph deformation. On the other hand, in the purge mode, a voltage is applied to the lower electrode 114 and the upper electrode 115, and the upper and lower layers namely the piezoelectric sheet 111 and the piezoelectric sheet 112 are made to undergo bimorph deformation. In other words, in the purge mode, it is possible to change the volume of the ink storage chamber 23 to a greater extent than in the printing mode in which the piezoelectric sheet 111 is deformed in the unimorph mode. When such an arrangement is made, out of the two piezoelectric sheets 111 and 112, only by changing the sheet to which the voltage is applied, it is possible to absorb the pressure fluctuation in the printing mode, and to generate the purge pressure in the purge mode. The remaining structure being similar to the structure in the first embodiment described above, the description thereof is omitted.

Figure 9:
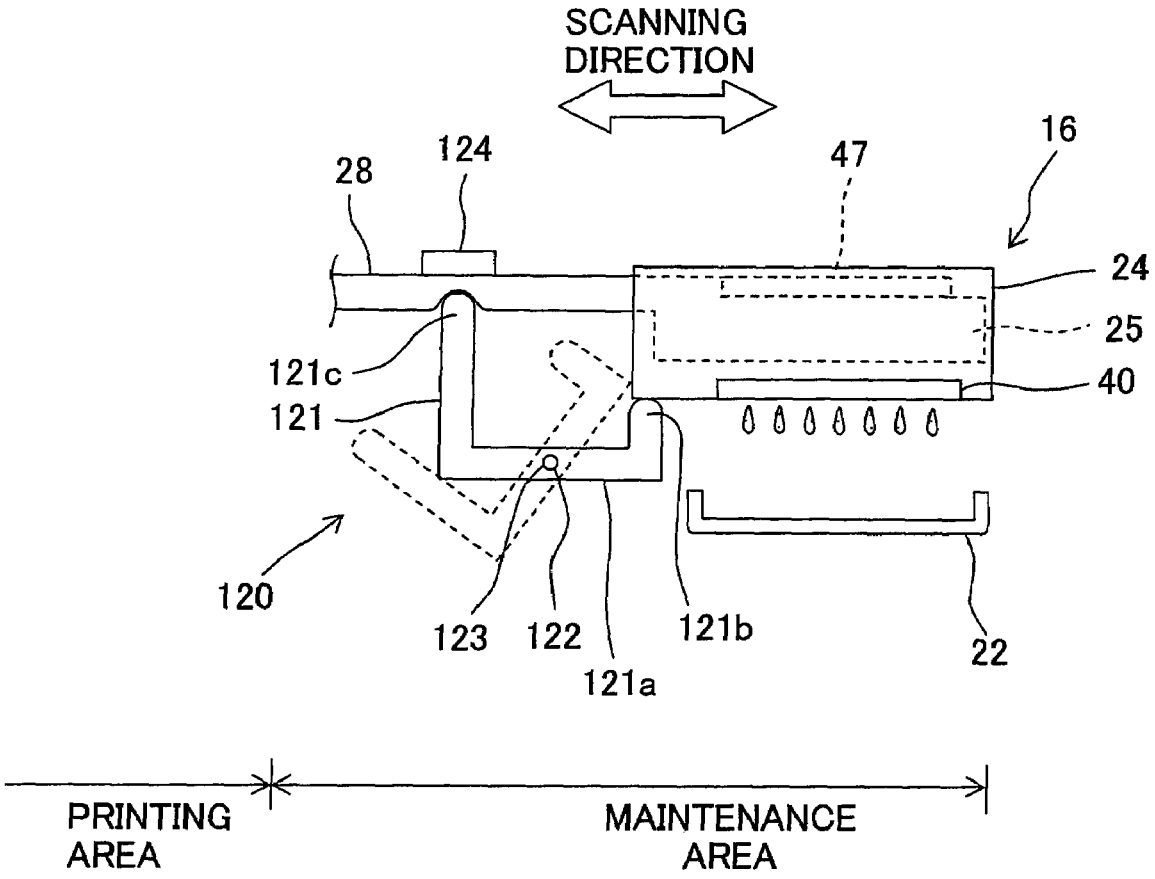
FIG. 9 is a cross-sectional view of key components showing a pinching mechanism included in an ink-jet printer of a third embodiment of the present invention.

FIG. 9 is a cross-sectional view of key components showing a pinching mechanism 120 of an ink-jet printer of a third embodiment of the present invention. As shown in FIG. 9, in the third embodiment, the pinching mechanism 120 is provided in the maintenance area (refer to FIG. 2) as a counter-flow preventing mechanism in the purge mode. The pinching mechanism 120 has an oscillator 121 which is arranged below a moving path of passing of the carriage 24, and a receiving body 124 which is fixed to a portion above the moving path of the carriage 24 to face the oscillator 121. The oscillator 121 is supported by a shaft 122 rotatably, and a coil spring 123 which applies a bias in a counterclockwise direction to the oscillator 121 is provided to the shaft 122.

The oscillator 121 has a base portion 121*a* on which the shaft 122 is installed, a short projection 121*b* which is projected to be short in an upward direction from one end portion of the base portion 121*a* toward the waste-liquid tray 22, a long projection 121*c* which is projected to be long in an upward direction from the other end portion of the base portion 121*a* toward the printing area. When the carriage 24 is in the printing area, the short projection 121*b* is positioned on the moving path of the carriage 24, and the long projection 121*c* is positioned at a position lower than the moving path of the carriage 24 (dotted line in the diagram).

On the other hand, when the carriage 24 moves up to a position above the waste-liquid tray 22, the short projection 121*b* is pushed downward by the carriage 24 resisting the coil spring 3, and the long projection 121*c* is moved upwardly. Accordingly, the long projection 121*c* pinches the ink supply tube 28 from outside between the receiving body 124. Accordingly, in the purge mode, it is possible to prevent easily a counter flow of the ink which is directed toward the ink supply tube 28 from the sub tank 25. The rest of the structure being similar to the structure in the first embodiment described above, the description thereof is omitted.

Figure 10:
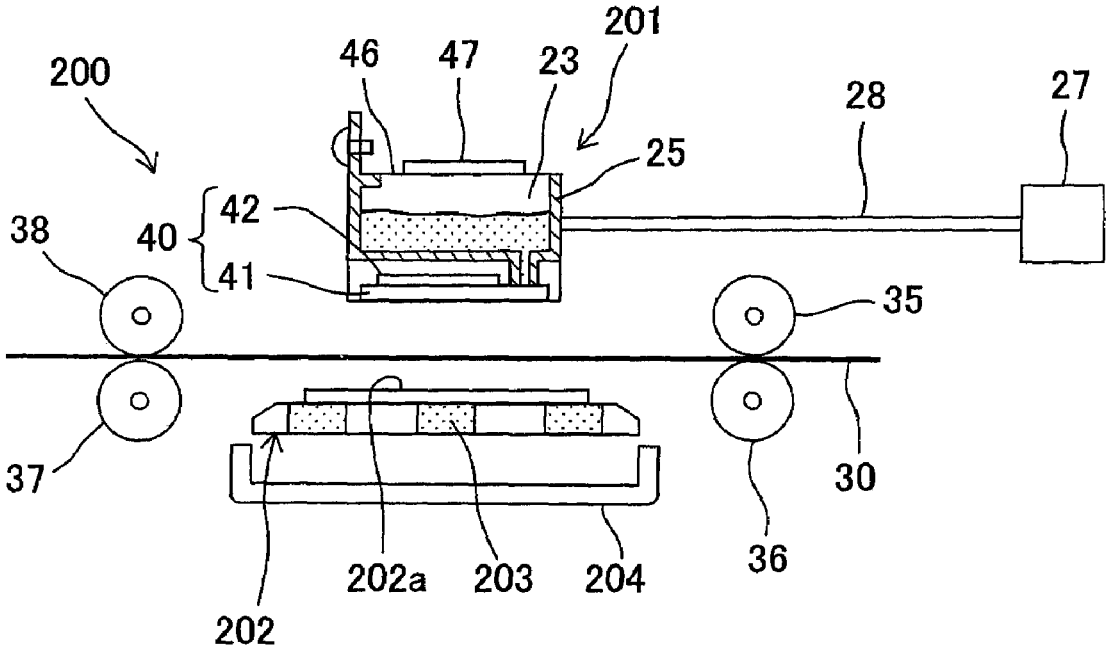
FIG. 10 is a partial cross-sectional view explaining schematically an ink-jet printer of a fourth embodiment of the present invention.
Figure 11:
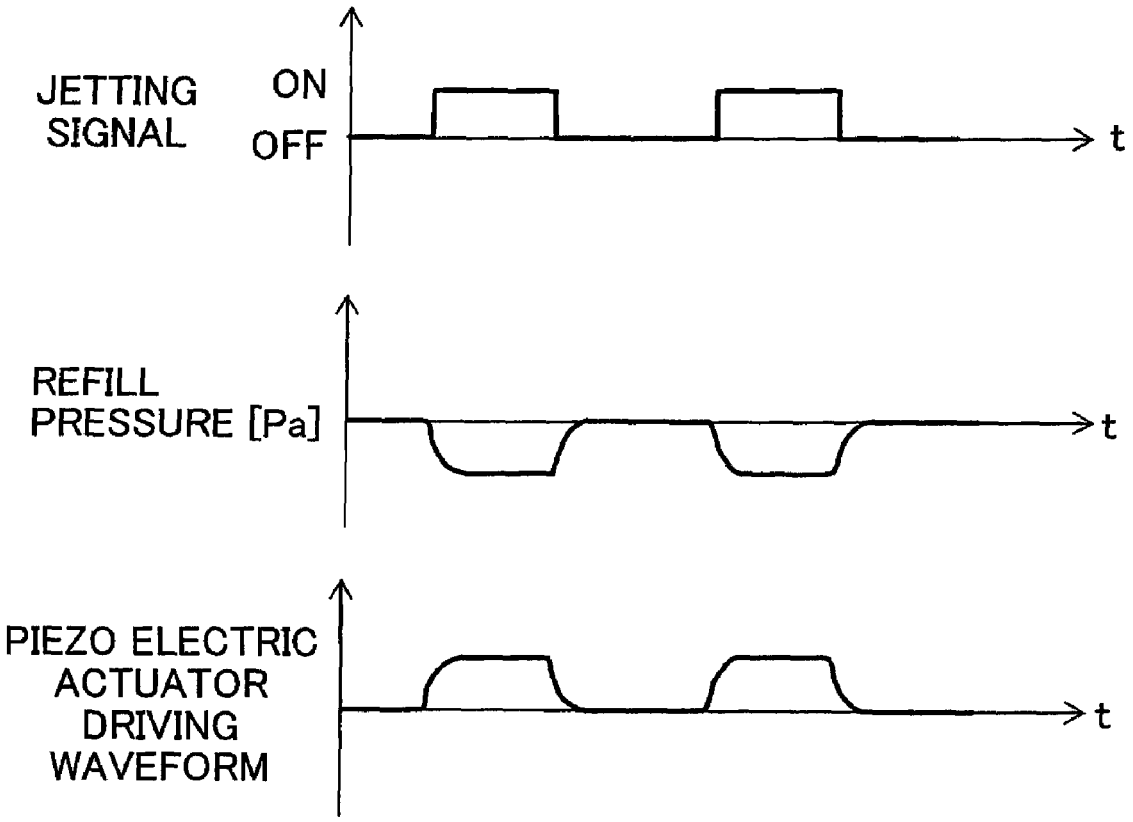
FIG. 11 is a timing chart of various operations of the ink-jet printer shown in FIG. 10.

FIG. 10 is a partial cross-sectional view explaining schematically an ink-jet printer 200 of a fourth embodiment of the present invention. FIG. 11 is a timing chart of various operations of the ink-jet printer 200 shown in FIG. 10. As shown in FIG. 10 and FIG. 11, the printer 200 of the fourth embodiment is a so-called line printer in which an image recording unit 201 is fixed, and it is possible to record at a time on the recording paper 30, a row of pixels arranged in a direction of width (rearward direction of paper surface) orthogonal to a paper feeding direction. A platen 202 is arranged at a lower side of the image recording unit 201. Ink absorbers 203 are provided at required locations on the platen 202, and a rib 202*a* which is projected upward is provided on the platen 202. A waste-liquid tray 204 is arranged beneath the platen 202.

In the ink-jet printer 200, in the printing mode, since the image recording unit 201 is stationary, the dynamic pressure due to the inertial force is not generated in the ink storage chamber 23 of the sub tank 25. However, there is no change in generation of the refill pressure in the ink storage chamber 23 of the sub tank 25 by jetting the ink from the ink-jet head 40 (refer to FIG. 11). Accordingly, by driving the damper piezoelectric actuator 47 to cancel the refill pressure, the pressure wave is prevented from being propagated to the nozzles of the ink-jet head 40. The rest of the structure being similar to the structure in the first embodiment, the description thereof is omitted.

In the embodiments described above, a structure in which the damper piezoelectric actuator 47 is attached directly on the damper film 46 is used as a volume changing mechanism. However, another form may be used provided that it is capable of changing the volume of the ink storage chamber 23 of the sub tank 25. For instance, a piston which closes the upper surface opening of the ink storage chamber 23 of the sub tank 25 and slides along an inner wall of the ink storage chamber 23, and an actuator may be provided. In this case, by deforming the actuator, it is possible to slide the piston along the inner wall of the ink storage chamber 23, and to change the volume of the ink storage chamber 23. Or, the sub tank may be bellows, and the volume of the ink storage chamber 23 may be changed. In this case, an actuator for deforming the sub tank in the form of bellows may further be provided, and it is possible to deform the sub tank by deforming the actuator. The damper piezoelectric actuator 47 may be used as a pressure detecting sensor which detects a pressure applied to the damper film 46 by a counter electromotive force, and a control in which the pressure fluctuation is suppressed by feeding back a detected value may be carried out.

The embodiments from the first embodiment to the third embodiment described above are examples in which the present invention is applied to a serial printer, and in the printing mode, total pressure fluctuation in which the dynamic pressure and the refill pressure are superimposed is generated in the ink in the ink storage chamber 23 of the sub tank 25. The main control unit 50 controls the damper piezoelectric actuator 47 to cancel the total pressure fluctuation. However, the main control unit 50 may not control the damper piezoelectric actuator 47 so that it cancels both the dynamic pressure and the refill pressure. For instance, when the refill pressure has an extremely small effect on a printing quality as compared to the dynamic pressure, the main control unit 50 may control the damper piezoelectric actuator 47 to drive such that only the dynamic pressure is canceled. In a reverse case, the main control unit 50 may control the damper piezoelectric actuator 47 to drive such that only the refill pressure is canceled.

In the first, second, and fourth embodiments described above, the non-return valve mechanism 45 has been used as the counter-flow preventing mechanism. However, for instance, an openable door which is opened only when the ink flows into the ink storage chamber 23 of the sub tank 25 from the main tank 27 may be provided to the inflow port 23. In this case, a bias is applied to the openable door all the time by a coil spring for example, to close the inflow port of the sub tank 25. The openable door is opened by a pressure when the ink flows to the ink storage chamber 23 from the main tank 27, but is not opened when the ink flows back to the main tank 27 from the ink storage chamber 23. Or, an electromagnetic valve may be provided to the inflow port 23 of the sub tank 25, and an opening and closing of the electromagnetic valve may be controlled by the main control unit 50.

In all the embodiments described above, the actuator 42 of piezoelectric-drive type has been used as the pressure applying mechanism. However, an actuator which is displaced by a static electricity or an actuator which applies a pressure by generating air bubbles by a thermal energy may be used.

In all the embodiments described above, the present invention is applied to an ink-jet printer. However, the present invention may also be applied to a liquid jetting apparatus which is used in an apparatus for manufacturing a color filter of a liquid-crystal display unit by jetting a colored liquid and an apparatus for forming an electrical wiring by jetting an electroconductive liquid.

In all the embodiments described above, the main tank 27 was let to be detachable from the main tank mounting portion 26 so that the main tank 27 is replaceable. However, the present invention is also applicable to a liquid droplet jetting apparatus of a type in which, the main tank 27 is equipped to be non-replaceable from the ink-jet printer 3 as in a portable printer, and when a liquid is exhausted, it is to be replenished upon setting by a liquid vender.

What is claimed is:

1. A liquid droplet jetting apparatus which jets liquid droplets of a liquid stored in a main tank, comprising:

a main-tank attachment section to which the main tank is detachably attached;

a sub tank having a liquid storage chamber communicating with the main tank attached to the main-tank attachment section;

a liquid droplet jetting head having:

nozzles from which the liquid droplets are jetted;

channels, each of which communicates with the sub tank and guides the liquid flowed from the sub tank to the nozzles; and a pressure applying mechanism which applies, to the liquid in the channels, a pressure directed toward the nozzles to jet the liquid droplets from the nozzles;

a volume changing mechanism which changes a volume of the liquid storage chamber of the sub tank;

a counter-flow preventing mechanism which prevents a counter flow of the liquid toward the main tank from the liquid storage chamber of the sub tank; and a controller which controls the volume changing mechanism to change the volume of the liquid storage chamber and to suppress a pressure fluctuation in the liquid storage chamber in a liquid-droplet jetting mode of jetting the liquid droplets with the pressure applied by the pressure applying mechanism, and which controls the volume changing mechanism to change the volume of the liquid storage chamber and to transport the liquid in the liquid storage chamber to the liquid droplet jetting head in a purge mode of discharging the liquid in the liquid droplet jetting head forcibly from the nozzles;

wherein the counter-flow preventing mechanism is a non-return valve mechanism including a valve element which is movable toward an opening position to open the channel upon receiving a flow of the liquid from the main tank directed toward the liquid storage chamber, and which is movable toward a closing position to close the channel upon receiving a counter flow of the liquid from the liquid storage chamber toward the main tank;

wherein the valve element is not moved to the closing position by the counter flow due to the pressure fluctuation inside the liquid storage chamber in the liquid jetting mode, and is moved toward the closing position by the counter flow due to pressure fluctuation in the liquid storage chamber in the purge mode;

wherein the valve element is arranged at an inflow port of the liquid formed in a sub tank, the valve element including:

a shaft which has one end inserted in the inflow port with a clearance space with respect to the inflow port; and an umbrella portion which is elastic and is projected in an umbrella shape folding back from the other end of the shaft; and wherein a projection extending in a radial umbrella portion is formed on a surface of the umbrella portion, the surface facing the shaft.

2. The liquid droplet jetting apparatus according to claim 1;

wherein the controller has a head control section which controls the liquid droplet jetting head to jet the liquid droplets; and wherein the controller controls, in the liquid-droplet jetting mode, the volume changing mechanism, based on a jetting amount information obtained from the head control section, to change the volume of the liquid storage chamber.

3. The liquid droplet jetting apparatus according to claim 1; wherein the sub tank is attached to the liquid droplet jetting head.

4. The liquid droplet jetting apparatus according to claim 1; wherein the liquid droplet jetting head jets, in the liquid-droplet jetting mode, the liquid droplets from the nozzles in a stationary state in which the liquid droplet jetting head and the sub tank are stationary.

5. The liquid droplet jetting apparatus according to claim 1, further comprising:

a moving mechanism which reciprocates the liquid droplet jetting head together with the sub tank; and a liquid supply tube which communicates the main tank and the sub tank;

wherein the controller has a moving mechanism control section which controls the moving mechanism; and the controller controls, in the liquid-droplet jetting mode, the volume changing mechanism, based on a movement information of the sub tank obtained from the moving mechanism control section, to change the volume of the liquid storage chamber.

6. A liquid droplet jetting apparatus which jets liquid droplets of a liquid stored in a main tank, comprising: a main-tank attachment section to which the main tank is detachably attached; a sub tank having a liquid storage chamber communicating with the main tank attached to the main-tank attachment section; a liquid droplet jetting head having: nozzles from which the liquid droplets are jetted; channels, each of which communicates with the sub tank and guides the liquid flowed from the sub tank to the nozzles; and a pressure applying mechanism which applies, to the liquid in the channels, a pressure directed toward the nozzles to jet the liquid droplets from the nozzles; a volume changing mechanism which changes a volume of the liquid storage chamber of the sub tank; a counter-flow preventing mechanism which prevents a counter flow of the liquid toward the main tank from the liquid storage chamber of the sub tank; a controller which controls the volume changing mechanism to change the volume of the liquid storage chamber and to suppress a pressure fluctuation in the liquid storage chamber in a liquid-droplet jetting mode of jetting file liquid droplets with the pressure applied by the pressure applying mechanism, and which controls the volume changing mechanism to change the volume of the liquid storage chamber and to transport the liquid in the liquid storage chamber to the liquid droplet jetting head in a purge mode of discharging the liquid in the liquid droplet jetting head forcibly from the nozzles; a moving mechanism which reciprocates the liquid droplet jetting head together with the sub tank; and a liquid supply tube which communicates the main tank and the sub tank; a tray which receives the liquid discharged forcibly from the nozzles, in the purge mode; wherein the controller has a moving mechanism control section which controls the moving mechanism; and the controller controls, in the liquid-droplet jetting mode, the volume changing mechanism, based on a movement information of the sub tank obtained from the moving mechanism control section, to change the volume of the liquid storage chamber; and wherein the counter-flow preventing mechanism is a pinching mechanism which pinches an outer portion of the liquid supply robe and blocks an internal channel of the tube when the liquid droplet jetting head is moved by the scanning mechanism to a position above the tray.

7. The liquid droplet jetting apparatus according to claim 6, further comprising:

a maintenance area to which the liquid droplet jetting head is moved in the purge mode;

wherein the pinching mechanism is arranged at the maintenance area together with the tray, the pinching mechanism having:

an oscillator which is arranged below a moving path of the liquid droplet jetting head; and a receiver which is fixed to a portion above the moving path of the liquid droplet jetting head to face the oscillator;

wherein the liquid supply tube is pinched with the oscillator and the receiver.

8. The liquid droplet jetting apparatus according to claim 1; wherein the sub tank has a damper film which forms at least a part of a wall which defines the liquid storage chamber; and wherein the volume changing mechanism includes:

a piezoelectric actuator which deforms the damper film; and a voltage applying mechanism which applies a voltage to the piezoelectric actuator.

9. The liquid droplet jetting apparatus according to claim 8; wherein the piezoelectric actuator is attached directly on a surface, of the damper film, not facing the liquid storage chamber.

10. The liquid droplet jetting apparatus according to claim 8;

wherein, in the purge mode, the controller controls the voltage applying mechanism to apply to the piezoelectric actuator a voltage higher than a voltage in the liquid-droplet jetting mode, and causes the piezoelectric actuator to be deformed to a greater extent than in the liquid-droplet jetting mode to change the volume of the liquid storage chamber to a greater extent than in the liquid-droplet jetting mode.

11. The liquid droplet jetting apparatus according to claim 8;

wherein the piezoelectric actuator has two piezoelectric sheets;

wherein, in the liquid-droplet jetting mode, the controller controls the voltage applying mechanism to apply a voltage to only one of the piezoelectric sheets so that the one of the piezoelectric sheets is deformed in a unimorph mode; and wherein, in the purge mode, the controller controls the voltage applying mechanism to apply a voltage to both of the two piezoelectric sheets so that the two piezoelectric sheets are deformed in a bimorph mode.

12. A liquid droplet jetting apparatus which jets liquid droplets of a liquid, comprising:

a main tank which stores the liquid;

a sub tank having a liquid storage chamber communicating with the main tank via a tube which is connected to the main tank;

a liquid droplet jetting head having:

nozzles from which the liquid droplets are jetted;

channels, each of which communicates with the sub tank and guides the liquid flowed from the sub tank to one of the nozzles; and a pressure applying mechanism which applies, to the liquid in the channels, a pressure directed toward the nozzles to jet the liquid droplets from the nozzles;

a volume changing mechanism which changes a volume of the liquid storage chamber of the sub tank;

a counter-flow preventing mechanism which prevents a counter flow of the liquid toward the main tank from the liquid storage chamber of the sub tank; and a controller which controls the volume changing mechanism to change the volume of the liquid storage chamber and to suppress a pressure fluctuation in the liquid storage chamber in a liquid-droplet jetting mode of jetting the liquid droplets with the pressure applied by the pressure applying mechanism, and which controls the volume changing mechanism to change the volume of the liquid storage chamber and to transport the liquid in the liquid storage chamber to the liquid droplet jetting head in a purge mode of discharging the liquid in the liquid droplet jetting head forcibly from the nozzles;

wherein the counter-flow preventing mechanism is a non-return valve mechanism including a valve element which is movable toward an opening position to open the channel upon receiving a flow of the liquid from the main tank directed toward the liquid storage chamber, and which is movable toward a closing position to close the channel upon receiving a counter flow of the liquid from the liquid storage chamber toward the main tank;

wherein the valve element is not moved to the closing position by the counter flow due to the pressure fluctuation inside the liquid storage chamber in the liquid jetting mode, and is moved toward the closing position by the counter flow due to a pressure fluctuation in the liquid storage chamber in the purge mode;

wherein the valve element is arranged at an inflow port of the liquid formed in a sub tank, the valve element including:

a shaft which has one end inserted in the inflow port with a clearance space with respect to the inflow port: and an umbrella portion which is elastic and is projected in an umbrella shape folding back from the other end of the shaft; and wherein a projection extending in a radial direction of the umbrella portion is formed on a surface of the umbrella portion, the surface facing the shaft.

* * * * *